US005232235A

United States Patent [19]

Brooks

[11] Patent Number: 5,232,235

[45] Date of Patent: Aug. 3, 1993

[54] SKATEBOARD STEERING MECHANISM

[76] Inventor: Paul F. Brooks, 708 E. 8125 South, Sandy, Utah 84094

[21] Appl. No.: 988,868

[22] Filed: Dec. 8, 1992

Related U.S. Application Data

[63] Continuation-in-part of Ser. No. 754,008, Sep. 3, 1991, Pat. No. 5,169,166.

[51] Int. Cl.[5] ..... A63C 17/01

[52] U.S. Cl. ..... 280/87.042; 280/11.27; 280/112.2

[58] Field of Search ..... 280/11.19, 11.27, 11.28, 280/22.1, 87.041, 87.042, 86, 100, 111, 112.2, 688

[56] References Cited

U.S. PATENT DOCUMENTS

| | | | |
|---|---|---|---|
| 2,509,324 | 5/1950 | Van Horn | 280/11.28 |
| 3,331,612 | 7/1967 | Tietge | 280/87.042 X |
| 4,020,914 | 5/1977 | Trautwein | 280/112.2 X |
| 4,036,506 | 7/1977 | Scheib | 280/22.1 |
| 4,398,734 | 8/1983 | Barnhard | 280/11.28 |
| 4,740,004 | 4/1988 | McMullen | 280/112.2 X |
| 4,998,596 | 3/1991 | Miksitz | 280/112.2 X |
| 5,040,812 | 8/1991 | Patin | 280/112.2 X |
| 5,161,810 | 11/1992 | DeCesare | 280/14.2 |

*Primary Examiner*—Margaret A. Focartino
*Assistant Examiner*—Michael Mar
*Attorney, Agent, or Firm*—Bryan A. Geurts

[57] ABSTRACT

A novel skateboard steering mechanism is provided which has both wheel tilting and steering capabilities. The steering mechanism comprises generally a platform, a plunger which is fixedly attached at one end of the bottom face of the platform, top and bottom axles of equal length disposed in parallel aligned space relationship to each other, a pair of wheels, and a steering assembly.

Advantageously, the plunger encases the entire steering assembly and holds it within a set position. The steering assembly comprises upper and lower balls rigidly affixed to the top and bottom axles, respectively, at approximately the mid points thereof, a floating cam disposed between the upper and lower balls, and a wire spring, or similar, biasing the floating cam in a set position.

10 Claims, 3 Drawing Sheets

SKATEBOARD STEERING MECHANISM

This application is a continuation-in-part of application Ser. No. 07/754,008, filed Sep. 3, 1991 now U.S. Pat. No. 5,169,166.

BACKGROUND

1. Field

The present invention relates generally to steering mechanisms which respond to weight changes made by the operator and more specifically to a steering truck for use mainly with skateboards, but also roller skates, scooters, and other similar skate-type devices wherein the wheels are not only turned but also tilted responsive to an operator's weight changes.

2. Prior Art

Steering trucks and similar steering mechanisms which are weight responsive are well known in the art. Generally, such mechanisms are attached to the bottom face of a platform or similar planar member upon which a weight rests or stands. Responsive to a change in the center of mass of the weight from one longitudinal side to the other, the platform tilts slightly to cause the mechanism to adjust the direction in which attached wheels are pointing.

While necessarily small in diameter, the wheels attached to such mechanisms have a relatively substantial width, such width often exceeding that of the diameter. Typical of this type of steering mechanism are U.S. Pat. No. 2,509,324, issued to Van Horn in 1986 and U.S. Pat. No. 4,398,734, issued to Barnard in 1983. Both the Barnard and Van Horn patents disclose a plunger which is rigidly affixed at one end to the bottom face of a platform, the plunger extending downwardly. An axle having wheels rotatably attached at both ends is affixed to the other end of the plunger, the axle including a leg which extends forwardly. The leg is attached to a leg holder which allows universal movement of the leg.

In this manner, when the center of mass of a weight atop the platform is shifted to one side of the platform or another, the platform and plunger correspondingly shift or tilt slightly, the plunger thereby causing the axle and wheels to turn.

While adequate for a number of applications, the type of steering truck just described includes a number of disadvantages. For example, this configuration requires that the wheels be fairly close together. This can become a problem when the steering mechanism is called upon to make sharp turns since the platform may tilt far enough over to make contact with the wheels. Thus, this configuration not only limits the turning radius of this type of steering mechanism, but the platform contacting the wheels can cause a dangerous situation as well.

For example, many skateboard riders, when riding their skateboard, have parts of their feet which hang over the edge of the platform. When making a sharp turn, it is not only conceivable, but probable, that this portion of the rider's foot which is hanging over the edge of the platform will come in contact with a wheel, or wheels, thereby throwing the rider off balance and probably causing an accident. Also, if the platform can come in contact with the wheels during a turn, undue wear and tear is caused on both the wheels and the platform.

Another problem caused by the configuration mentioned above is the size of the wheels. While providing a greater contact area with the ground, such wheels cannot tilt into a turn to assist in gripping the ground surface. Indeed, even assuming that such steering mechanisms provided for tilt in the wheels, which they do not, the extra wide wheels commonly used on skateboards could not be tilted during a turning maneuver without virtually eliminating the ground contact sought to the maintained by use of the wide wheels. Thus, without the ability to tilt, horizontal forces experienced during the course of a turn, caused by the tendency of an object to travel in a straight path, must be completely absorbed by frictional forces between the wheels and the ground.

Therefore, there exists in the prior art a legitimate need for a steering mechanism which not only provides steering capabilities, but also provides tilting capabilities as well to allow increased turning capacity.

BRIEF SUMMARY AND OBJECTS OF THE INVENTION

In view of the above described state of the art, the present invention seeks to realize, among other things, the following objects and advantages.

A principal object of the present invention is to provide a novel steering truck mechanism which combines steering capabilities with tilting capabilities.

Another major object of the present invention is to provide a steering mechanism which is controlled by the transfer of weight about various points on a platform, said platform tilting slightly in response to the transfer of weight.

It is also an important object of the present invention to provide a steering mechanism controlled by weight transfer, as mentioned above, wherein the platform cannot come in contact with the wheels.

Still another principal objective of this invention is to provide a steering mechanism which includes wheels which have increased rotating capacity relative to the ground due to decreased friction.

Yet another major objective of the invention is to provide a high performance steering mechanism for use with skateboards which allows safer travel at higher speeds due to a wider wheel base and an increased turn capability due to tilting wheels.

It is a further object of the present invention to provide a steering mechanism which is efficient, durable, easily assembled, light weight, easily manufactured, and safe.

Accordingly, the skateboard steering mechanism of the present invention comprises generally a platform, such as that which is known in the art of skateboarding; a plunger which has a proximate end which is fixedly attached to the bottom broad face of the platform, and a distal end which extends downwardly from the platform; top and bottom axles of equal length disposed in parallel aligned spaced relationship to each other; a pair of wheels, one end of both the top and bottom axles being hingedly connected to the first wheel and the other end of both axles being hingedly connected to the second wheel; and a steering assembly for changing the direction of the wheels with respect to the platform when a downward vertical force is applied to either the first or the second longitudinal side of the platform.

One skilled in the art will recognize that the plunger, together with the top and bottom axles, in the present preferred relationship to each other, form an assembly which cause the wheels to tilt when a downward vertical force is applied to either one longitudinal side of the platform or the other.

The steering assembly comprises generally an upper ball which is rigidly affixed to the top axle at approximately the midpoint thereof, a lower ball which is rigidly affixed to the bottom axle at approximately the midpoint thereof, a floating cam disposed between the upper and lower balls, and a device, or similar, which biases the floating cam in a set position. Although many different devices, or similar, may be used to accomplish the task of biasing the floating cam in a set position, a leaf or wire spring is currently preferred.

The floating cam advantageously has a plurality of curved surfaces. Also, each of the preferred balls includes a roller, the roller on the upper ball extending downwardly and the roller on the lower ball extending upwardly, such that both rollers rest on a portion of one of the curved surfaces on the floating cam. In this preferred position, the two rollers are directly opposite each other on opposing curved surfaces.

Advantageously, the plunger has a hollowed cylindrical shape, and thus may encase the entire steering mechanism. This provides added protection and strength to the steering assembly.

The hinged connection of the ends of the wheels to the axles is preferably accomplished by means of a quick release mechanism. Such a mechanism may be formed by an aperture in each wheel which includes a plurality of nipples and a locking mechanism for locking the nipples in a set position, and a plurality of recesses disposed in the ends of the axles into which the nipples can be inserted.

Each wheel may take a variety of different forms, but the preferred wheel comprises a hub to which the axles are hingedly connected, a tire, a race which is fixedly attached to the interior surface of the tire, and a set of roller bearings disposed between the race and the hub such that the hub remains in a stationary position while the race and tire rotate when the skateboard steering mechanism is in motion.

DESCRIPTION OF THE DRAWINGS

In order that the manner in which the above-recited and other advantages and objects of the invention are obtained can be appreciated, a more specific description of the invention briefly described above will be rendered by reference to specific embodiments thereof which ar illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1:
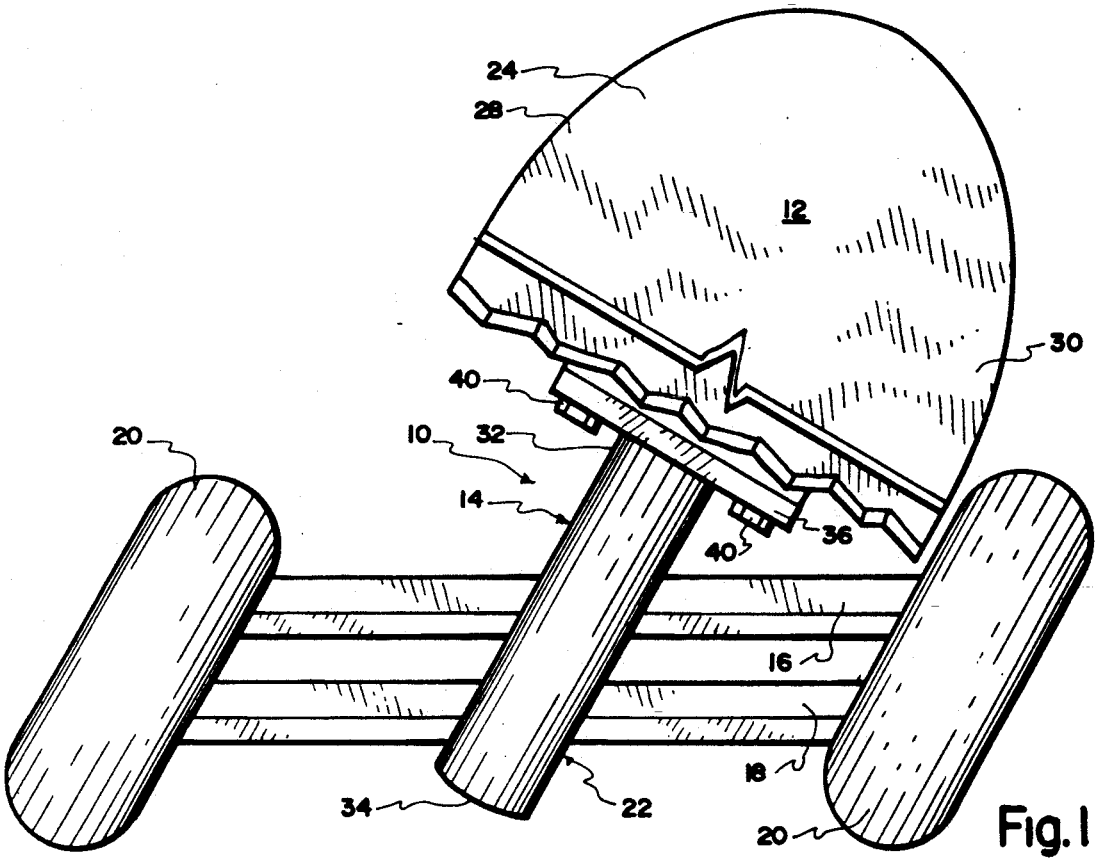
FIG. 1 is a partial front perspective view of the preferred embodiment of the present invention illustrating both steering and tilting capabilities.

Reference is now made to the drawings wherein like numerals are used to designate like component parts throughout. The presently preferred skateboard steering mechanism, generally designated 10, which has both wheel tilting and steering capabilities, comprises generally a platform 12, a plunger 14, identical top and bottom axles 16 and 18 respectively, a set of wheels 20 and a steering assembly 22. Each of these components will be described in greater detail hereafter.

The platform 12 is preferably a rigid planar member which may take a variety of different shapes. One preferred shape thereof is substantially rectangular such as may be used in conjunction with a skateboard. One skilled in the art will recognize that the shape of the platform 12 is best determined by the desired use of the steering mechanism 10.

Advantageously, the platform 12 is constructed of a substantially rigid material such as wood or plastic. Other materials, such as wood composites, steel, aluminum and the like is also contemplated and falls within the purview of this invention.

The platform 12 includes top and bottom broad faces 24 and 26 respectively. When used in conjunction with a skateboard, the top broad faced 24 and the platform 12 accommodates the operator, who stands thereon during operation. When used for other applications, any weight to be carried by the steering mechanism is normally carried on the top broad face 24 of the platform 12.

The platform 12 further comprises first and second longitudinal sides 28 and 30 respectively upon which a downward vertical force may be applied. As will be more fully explained hereafter, the skateboard steering mechanism 10 is actuated by a force, usually the weight of the operator, which is focused on either the first longitudinal side 28 or the second longitudinal side 30 of the platform 12.

The plunger 14 is generally cylindrical in shape and has a proximate end 32 and a distal end 34. The proximate end 32 of the plunger 14 is fixedly attached to the bottom broad face 24 of the platform 12. Advantageously, this is accomplished by inclusion of an integrated plate 36 which is disposed normally to the longitudinal axis of the plunger 14.

At present preference, the integrated plate 36 includes a plurality of apertures 38 at spaced intervals. Screws or bolts 40 may pass through the apertures 38 to attach the plunger 14 to the bottom broad face 26 of the platform 12. Alternative methods of attaching the plunger 14 to the platform 12 in fixed fashion, which are standard in the industry, are contemplated and thus should be considered within the scope of this invention.

The distal end 34 of the plunger 14 extends downwardly from the platform. Preferably, the plunger 14 is disposed vertically when the skateboard steering mechanism 10 is at rest, although variance from the vertical is crucial to the steering and tilting capabilities of the skateboard steering mechanism 10.

The plunger 14, at approximately mid shaft, includes two oppositely positioned slots, not shown, through which the axles 16 and 18 extend. Also, the distal end 34 of the plunger 14 may include a recess 42. See FIG. 3. The recess 42 accommodates a strap 44, or similar, which extends about the circumference of the cylindrically shaped plunger 14, the strap 44 being held in place and tightened by a quick release buckle 46, or similar. The strap 44 and quick release buckle 46 together hold the plunger 14 in a desired position, since the cylindrically shaped plunger 14 is advantageously split into two identical pieces to provide better access to the steering assembly 22, which is hereafter described in greater detail.

Figure 3:
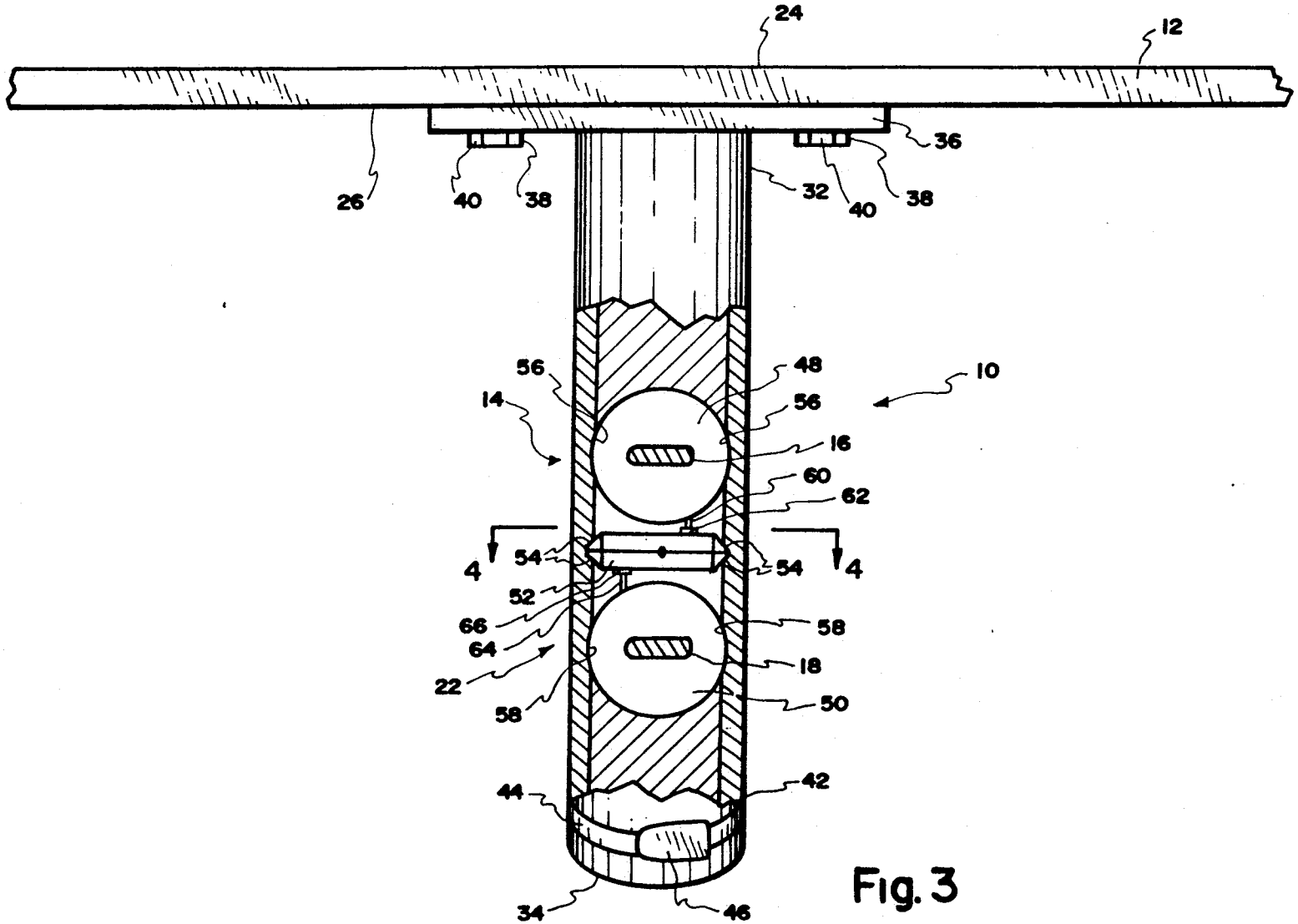
FIG. 3 is a partial side elevational view of the embodiment of FIG. 1, taken along the lines 3—3 of FIG. 2 and shown enlarged.

The quick release buckle 46 shown in FIG. 3 is a standard quick release mechanism such as that used to fasten a ski boot. While this is the quick release mechanism currently contemplated, one skilled in the art will recognize that any number of quick release mechanisms which perform this same function in this same way will fall within the purview of this invention.

The steering assembly 22, which is advantageously encased by the cylindrically shaped plunger 14, comprises an upper ball 48, a lower ball 50, a floating cam 52, and a spring 54 which biases the floating cam 52 in a set position. Importantly, the upper ball 48 is rigidly affixed to the top axle 16 at approximately the mid point thereof, while the lower ball 50 is rigidly affixed to the bottom axle 18 at approximately the mid point thereof. Thus, as best seen in FIG. 3, the balls 48 and 50 are positioned one atop the other relative to each other.

Each of the balls 48 and 50 further may be either hollow or solid although a solid ball provides greater strength and durability to the skateboard steering mechanism 10. Again referring to FIG. 3, the upper ball 48 remains in a stable position relative to the plunger 14 because it is seated within the plunger 14 in a recess 56. Similarly, although oppositely, the lower ball 50 is held in position within the plunger 14 by recess 58.

Significantly, the recesses 56 and 58 in which the upper ball 48 and lower ball 50, respectively, are seated allow the balls to rotate in position. This allows for the tilting action occasioned by the application of a downward vertical force on one of the longitudinal sides 28 or 30 of the top broad faced 24 of the platform 12.

Still referring to FIG. 3, the upper ball 48 includes a pin 60 which extends downwardly therefrom, the free end of the pin 60 having a cylindrical roller 62, which is in contact with the floating cam 52. See FIG. 4. Similarly, the lower ball 50 has an oppositely disposed pin 64 which extends upwardly therefrom, and which contains a cylindrical roller 66, which is in contact with the floating cam 52. See FIG. 4.

Figure 4:
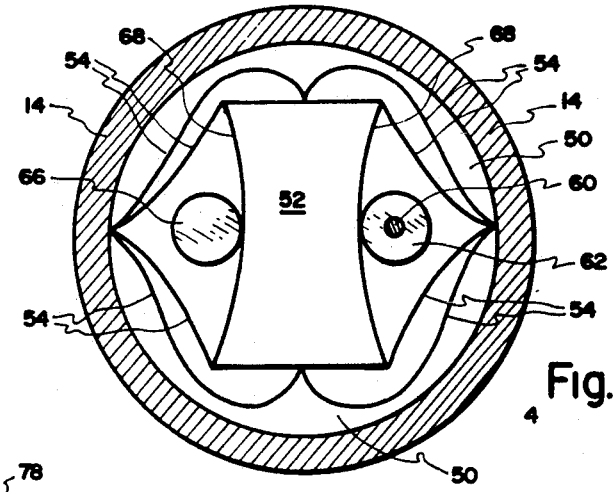
FIG. 4 is an enlarged cross sectional view of the plunger taken along the lines 4—4 of FIG. 3 and showing in detail the floating cam and rollers of the steering mechanisms.

The floating cam 52, best seen in FIG. 4, is a relatively flat plate-like component having the general shape of an hourglass. Preferably, the floating cam 52 includes a plurality (at least 2) of curved surfaces 68 and 70 upon which the rollers 62 and 66 rest.

As illustrated best in FIG. 3, the floating cam 52 is biased in a set position by a wire spring 54. Alternatively, the wire spring 54 could be replaced by a leaf spring, not shown, as well as any other type of common biasing component which is standard in the industry. One skilled in the art will immediately recognize that the spring 54 provides means for biasing the floating cam 52 in a set position.

Figure 2:
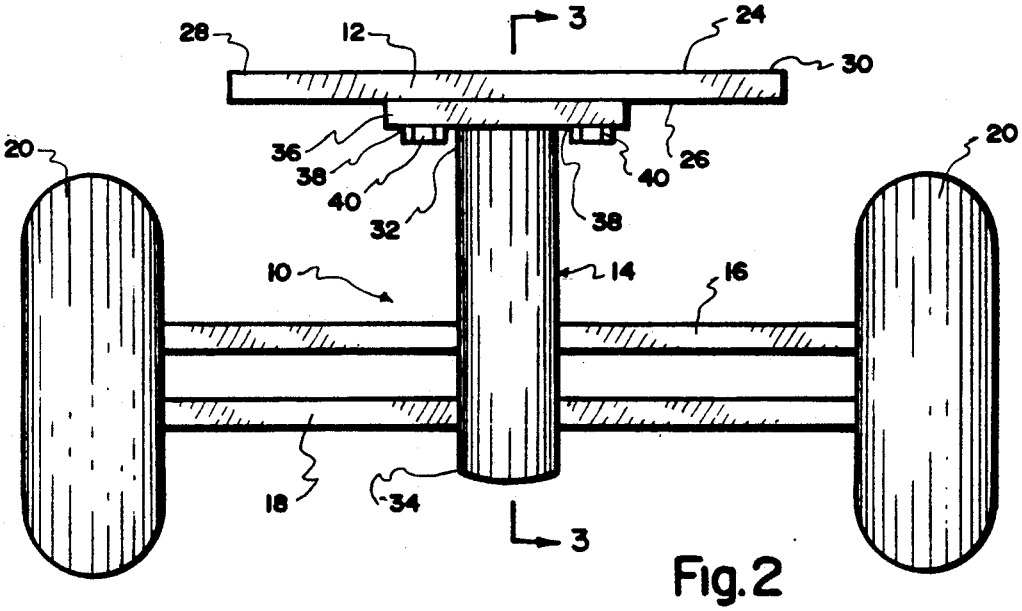
FIG. 2 is a front elevational view of the embodiment of FIG. 1.

Also, one skilled in the art will recognize that the steering assembly 22 comprises a means for changing the direction of the wheels 20 with respect to the platform 12 when a downward vertical force is applied to either the first longitudinal side 28 or the second longitudinal side 30 of the platform 12. Further, it would be obvious to one skilled in the art that the plunger 14, in combination with the top and bottom axles 16 and 18 respectively, form a means for causing the wheels 20 to tilt when the downward vertical force is applied to either the first longitudinal side 28 or second longitudinal side 30 of the platform 12. See FIGS. 1 and 2.

Figure 5:
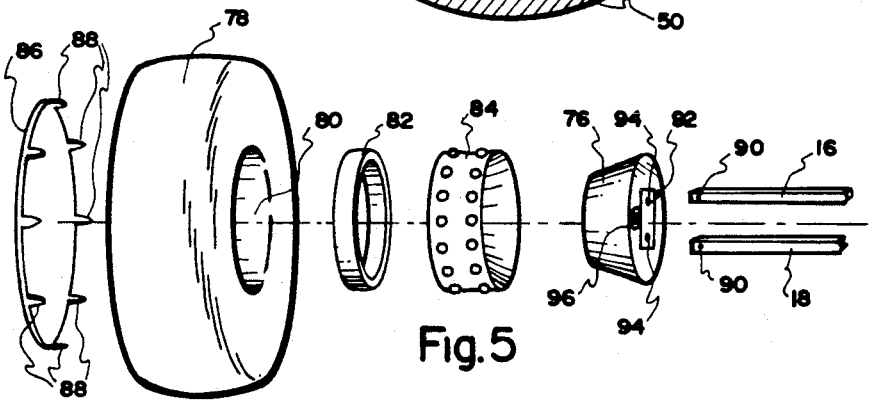
FIG. 5 is an exploded perspective view of the wheel assembly according to the principles of the present invention.
Figure 6:
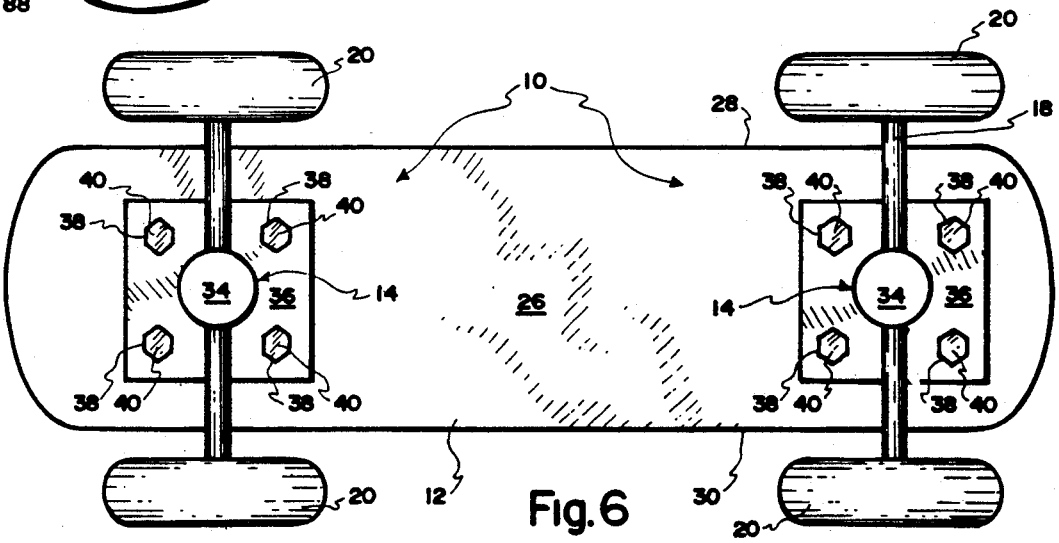
FIG. 6 is a bottom plan view of the invention of FIG. 1.

With reference now to FIG. 5, an exploded view of a typical wheel 20 is shown. As shown, in general each wheel 20 comprises a hub 76 to which the axles 16 and 18 are hingedly connected, a tire 78 which includes an interior surface 80, a race 82, and a set of roller bearings 84. Advantageously, a dust cover 86 is included and may be snapped onto the outside of each wheel 20 by means of biased hooks 88.

The top and bottom axles 16 and 18 respectively each comprise small recesses 90 disposed in the ends thereof. Each hub 76 comprises an aperture 92 which includes a plurality of nipples 94 which correspond to the recesses 90 in the axles 16 and 18. The hub 76 further comprises a locking mechanism 96 for locking the nipples 94 in a set position. The locking mechanism 96 is standard in the industry and thus is not described herein. Any device or mechanism which serves to lock the nipples 94 in a set position falls within the purview of this invention.

In use, the ends of the top and bottom axles 16 and 18 respectively are inserted into the aperture 92 such that the nipples 94 match and insert into the recesses 90. The locking mechanism 96 is then engaged to prevent the ends of the axles 16 and 18 from releasing.

As shown in FIG. 5, the hub 76 snap fits into the roller bearings 84, which are preferably simple bicycle tire bearings. The race 82 is fixedly attached to the interior surface 80 of the tire 78. The set of roller bearings 84 are then disposed between the race 82 and the hub 76 such that the hub 76 remains in a stationary position while the race 82 and tire 78 rotate when the skateboard steering mechanism 10 is in motion.

As indicated, the tilting and steering capabilities of the skateboard steering mechanism 10 are utilized by exerting a downward vertical force on either the first longitudinal side 28 or second longitudinal side 30 of the platform 12. This is most commonly accomplished by an operator who stands atop the platform 12 and changes his/her weight to one side of the platform 12 or the other so as to cause the skateboard steering mechanism 10 to steer in a desired manner.

Although the preferred embodiment of the present invention has been illustrated and described it is to be understood that the present disclosure is made by way of example and that various other embodiments are possible without departing from the subject matter coming within the scope of the following claims, which subject matter is regarded as the invention.

I claim:

1. A skateboard steering mechanism having both wheel tilting and steering capabilities, said skateboard steering mechanism comprising:

a platform having top and bottom broad faces and having first and second longitudinal sides upon which a downward vertical force may be exerted, a plunger having proximate and distal ends with an axis extending through said ends, the proximate end thereof being fixedly attached to the bottom broad face of the platform, and the distal end thereof extending downwardly from the platform, top and bottom axles of equal length disposed in parallel aligned spaced relationship to each other, said top and bottom axles intersecting said axis of said plunger, a pair of wheels, one end of both the top and bottom axles being hingedly connected to the first wheel and the other end of both axles being hingedly connected to the second wheel, and steering means for changing the direction of the wheels with respect to the platform when a downward vertical force is applied to either the first or second longitudinal side of the platform, the steering means having an upper ball rigidly affixed to the top axle at approximately a midpoint thereof, a lower ball rigidly affixed to the bottom axle at approximately a midpoint thereof, a floating cam disposed between the upper and lower balls, and means for biasing the floating cam in a set position.

2. A skateboard steering mechanism according to claim 1, further comprising means for causing the wheels to tilt when the downward vertical force is applied to either the first or second longitudinal side of the platform.

3. A skateboard steering mechanism according to claim 2, wherein the means for causing the wheels to tilt when the downward vertical force is applied comprises the plunger and the top and bottom axles.

4. A skateboard steering mechanism according to claim 1, wherein the means for biasing the floating cam in a set position is a wire spring.

5. A skateboard steering mechanism according to claim 1, wherein the means for biasing the floating cam in a set position is a leaf spring.

6. A skateboard steering mechanism according to claim 1, wherein the floating cam has a plurality of curved surfaces, and each of the balls includes a roller, the roller on the upper ball extending downwardly and the roller on the lower ball extending upwardly, such that both rollers rest on a portion of one of the curved surfaces on the floating cam.

7. A skateboard steering mechanism according to claim 1, wherein the steering means are encased within the plunger.

8. A skateboard steering mechanism according to claim 1, wherein each of the wheels is hingedly connected to the ends of the axles with a quick release mechanism.

9. A skateboard steering mechanism according to claim 1, wherein each wheel comprises:

a hub to which the axles are hingedly connected, a tire including an interior surface, a race fixedly attached to the interior surface of the tire, and a set of roller bearings disposed between the race and the hub such that the hub remains in a stationary position while the race and tire rotate when the skateboard steering mechanism is in motion.

10. A skateboard steering mechanism according to claim 8, wherein the quick release mechanism is a hinged connection between the ends of the axles and the wheels, which is formed by an aperture in each wheel which includes a plurality of nipples and a locking mechanism for locking the nipples in a set position, and a plurality of recesses disposed in the ends of the axles into which the nipples can be inserted.

* * * * *